US012714207B2

(12) United States Patent
Fukuhara et al.

(10) Patent No.: US 12,714,207 B2
(45) Date of Patent: Aug. 25, 2026

(54) SURFACE FASTENER

(71) Applicant: YKK Corporation, Tokyo (JP)

(72) Inventors: Yoshiyuki Fukuhara, Kurobe (JP); Shigeki Matsunaga, Kurobe (JP)

(73) Assignee: YKK Corporation, Tokyo (JP)

( * ) Notice: Subject to any disclaimer, the term of this patent is extended or adjusted under 35 U.S.C. 154(b) by 99 days.

(21) Appl. No.: 18/791,578

(22) Filed: Aug. 1, 2024

(65) Prior Publication Data

US 2025/0120480 A1 Apr. 17, 2025

(30) Foreign Application Priority Data

Oct. 11, 2023 (JP) ..... 2023-175842

(51) Int. Cl.
*A44B 18/00* (2006.01)

(52) U.S. Cl.
CPC ..... *A44B 18/0065* (2013.01); *A44B 18/0049* (2013.01)

(58) Field of Classification Search
CPC . A44B 18/0065; A44B 18/0049; Y10T 24/27; B29C 43/222
See application file for complete search history.

(56) References Cited

U.S. PATENT DOCUMENTS 5,713,111 A * 2/1998 Hattori ..... B29C 33/0027 264/173.1
5,845,375 A * 12/1998 Miller ..... A44B 18/0073 24/452
6,076,238 A * 6/2000 Arsenault ..... F16B 5/07 24/442

(Continued)

FOREIGN PATENT DOCUMENTS

DE 102004012067 A1 * 10/2005 ..... A44B 18/0065
DE 102012000374 A1 * 7/2013 ..... B29C 33/0027

(Continued)

OTHER PUBLICATIONS

Third Party Submission, U.S. Appl. No. 18/791,578, filed Jul. 3, 2025, 9 pages.
Poulakis, "Affidavit of Dr. Konstantinos Poulakis", Apr. 6, 2023, European Patent Office Register, https://register.epo.org/application?number=EP18804692&Ingen&tabdoclist, 42 pages.

(Continued)

*Primary Examiner* — Jason W San
*Assistant Examiner* — Matthew J Sullivan
(74) *Attorney, Agent, or Firm* — Kilpatrick Townsend & Stockton LLP

(57) ABSTRACT

To provide a surface fastener capable of stably ensuring an appropriate peel strength with respect to a loop member and capable of improving texture as compared with a conventional surface fastener. A surface fastener is made of a synthetic resin and includes: a base portion; and a plurality of engaging elements. Each of the engaging elements includes a stem portion, an engaging head portion, and at least one engaging portion protruding from an outer circumference portion of the engaging head portion. A total of the areas of the engaging head portions per 1 $cm^2$ of the surface fastener is 10,000,000 $\mu m^2$ or more when the surface fastener is viewed in plan view from above. The synthetic resin has a tensile modulus of 700 MPa or more and 2300 MPa or less.

3 Claims, 7 Drawing Sheets

(56) References Cited

U.S. PATENT DOCUMENTS

| | | | | |
|---|---|---|---|---|
| 8,695,624 | B2 * | 4/2014 | Hopf | A61M 39/223 604/32 |
| 11,089,845 | B2 * | 8/2021 | Fukuhara | A61F 13/625 |
| 11,219,285 | B2 * | 1/2022 | Fukuhara | B29C 43/46 |
| 11,533,971 | B2 * | 12/2022 | Yamashita | A61F 13/62 |
| 11,559,114 | B2 * | 1/2023 | Takekawa | A44B 18/0007 |
| 11,819,091 | B2 * | 11/2023 | Fukuhara | A44B 1/08 |
| 12,369,732 | B2 * | 7/2025 | Cosgrove | C09J 7/403 |
| 12,507,766 | B2 * | 12/2025 | Yang | A44B 18/0015 |
| 2009/0013506 | A1 * | 1/2009 | Mizuhara | A44B 18/0069 24/442 |
| 2019/0008239 | A1 * | 1/2019 | Fukuhara | A44B 18/0007 |
| 2023/0320464 | A1 * | 10/2023 | Heepe | A44B 18/0049 24/452 |
| 2023/0372167 | A1 * | 11/2023 | Poulakis | A44B 18/0065 |
| 2024/0251916 | A1 * | 8/2024 | Mochizuki | A44B 18/0003 |
| 2024/0349847 | A1 * | 10/2024 | Fukuhara | A44B 18/0019 |
| 2025/0009076 | A1 * | 1/2025 | Yokoyama | A44B 18/0049 |
| 2025/0120480 | A1 * | 4/2025 | Fukuhara | A44B 18/0049 |
| 2025/0351906 | A1 * | 11/2025 | Kuriyama | A41F 9/025 |

FOREIGN PATENT DOCUMENTS

| | | | | |
|---|---|---|---|---|
| WO | WO-2010030412 | A1 * | 3/2010 | F16M 13/027 |
| WO | 2017/109902 | A1 | 6/2017 | |
| WO | 2017/110825 | A1 | 6/2017 | |
| WO | 2023/105774 | A1 | 6/2023 | |

OTHER PUBLICATIONS

Wikipedia search result for "polypropylene", www.wikipedia.com, Jun. 27, 2025, 16 pages.

Office Action, Taiwanese Patent Application No. 113129160, Feb. 19, 2025, 20 pages.

Author: Dr. Konstantine Poulakis Title: Affidavit of Dr. Konstantinos Poulakis Pages Submitted: 21 Publication Date: Apr. 6, 2023 Publisher: Published in the register of the EPO Place of Publication: https://register.epo.prg/application?number=EP18804692&Ingen&tabdoclist The Affidavit is found under the selection: "Jun. 4, 2023 Citation in opposition procedure—028 Opposition 21" This register file belongs to an oppoisition filed against EP3700384 by YKK.†

Wikipedia search result when searching for "polypropylene" at www.wikipedia.com. Internet search performed on Jun. 27, 2025 at 2:19 pm.†

Author: Dr. Konstantine Poulakis Title: Attachment: 2 Claim Chart re Affidavit PDF.pdf.†

Affidavit of Dr. Konstantinos Poulakis Pages Submitted: 21 Publication Date: Apr. 6, 2023 Publisher: Published in the register of the EPO Place of Publication: https://register.epo.prg/application?number=EP18804692&Ingen&tabdoclist The Affidavit is found under the selection: "Jun. 4, 2023 Citation in opposition procedure—028 Opposition 21" This register file belongs to an oppoisition filed against EP3700384 by YKK. Wikipedia search result when searching for "polypropylene" at www.wikepedia.com. Internet search performed on Jun. 27, 2025 at 2:19 pm. Attachment: 2 Claim Chart re Wikipedia PDF.pdf.†

* cited by examiner
† cited by third party

SURFACE FASTENER

TECHNICAL FIELD

The present invention relates to a surface fastener.

BACKGROUND ART

Conventionally, products with a surface fastener, in which a loop member (also referred to as a female surface fastener) having a plurality of loops and a male surface fastener (hereinbelow abbreviated as a surface fastener) attachable to and detachable from the loop member are used in combination as a pair, are known. A typical surface fastener has a flat base portion and a plurality of male engaging elements provided on the upper surface of the base portion and having a hook shape, a mushroom shape, or the like, and is also called a hook member.

Nowadays, such surface fasteners are widely used in various products. Surface fasteners are used in many wearable products, such as disposable diapers, diaper covers for infants, supporters for protecting joints of hands and feet, waist corsets (back pain belts), and gloves.

A large number of surface fasteners used for disposable diapers and the like have been developed so far, and an example thereof is disclosed in, for example, International Publication No. 2017/109902 (PTL 1). The surface fastener described in PTL 1 has a base portion and a plurality of engaging elements protruding from the base portion. Each of the engaging elements in PTL 1 has a stem portion standing upright from the base portion and a disc-shaped engaging head portion formed integrally with an upper end of the stem portion. The engaging head portion is provided with a plurality of fine pawl portions protruding from the outer circumferential edge of the engaging head portion.

In the surface fastener in PTL 1, because the fine pawl portions are provided on the engaging head portions of the engaging elements, the loops of a loop member are easily hooked on the engaging elements, and the hooked loops are less likely to be disengaged from the engaging elements. Thus, it is possible to increase the peel strength (also referred to as the engagement strength) of the surface fastener with respect to the loop member. In addition, in PTL 1, because the pawl portions contributing to an increase in the peel strength are formed in a very small size on the outer circumferential edges of the engaging head portions, the texture of the surface fastener is less affected by the pawl portions. Therefore, it is possible to provide a surface fastener having a high engagement strength and a good texture.

CITATION LIST

Patent Literature

PTL 1: International Publication No. 2017/109902

SUMMARY OF INVENTION

Technical Problem

Surface fasteners used in products to be worn on the body, such as disposable diapers and diaper covers, are required to stably have an appropriate peel strength (also referred to as an engagement strength) such that the surface fasteners are not easily separated from the loop members even when the body moves in a state in which the surface fasteners are engaged with the loop members. Furthermore, depending on the product used, the surface fastener may come into direct contact with the skin. Hence, it is desired to further improve the texture of the surface side of the surface fastener, on which the engaging elements are arranged, so that soft texture can be obtained.

The present invention has been made in view of the above-described conventional problems, and an object thereof is to provide a surface fastener capable of stably ensuring an appropriate peel strength with respect to a loop member and improving the texture as compared with the conventional surface fastener.

Solution to Problem

In order to achieve the above object, a surface fastener provided by the present invention is a surface fastener made of a synthetic resin and including: a flat plate-shaped base portion formed to have a large length in a machine direction; and a plurality of engaging elements provided on an upper surface of the base portion. Each of the engaging elements includes a stem portion standing upright from the base portion, an engaging head portion provided at a top end portion of the engaging element and extending outward with respect to a boundary portion with the stem portion, and at least one engaging portion protruding from an outer circumference portion of the engaging head portion. A total of areas of the engaging head portions per 1 $cm^2$ of the surface fastener is 10,000,000 $\mu m^2$ or more when the surface fastener is viewed in plan view from above. The synthetic resin has a tensile modulus of 700 MPa or more and 2300 MPa or less.

In the surface fastener according to this invention, a formation density of the engaging elements is preferably 300 number/$cm^2$ or more.

In the present invention, a base end portion of the engaging portion is preferably formed to have a width smaller than half a dimension of the boundary portion of the engaging element in a direction perpendicular to the machine direction, the engaging portion preferably protrudes obliquely downward toward the base portion from the outer circumference portion of the engaging head portion, and an inclination angle at which a back surface of the engaging portion is inclined with respect to an upper-lower direction of the surface fastener is preferably 70° or less.

Advantageous Effects of Invention

The surface fastener according to the present invention is capable of stably ensuring an appropriate peel strength with respect to the loop member and improving the texture as compared with the conventional surface fastener.

DESCRIPTION OF EMBODIMENTS

Hereinbelow, a preferred embodiment of the present invention will be described with reference to the drawings.

Figure 1:
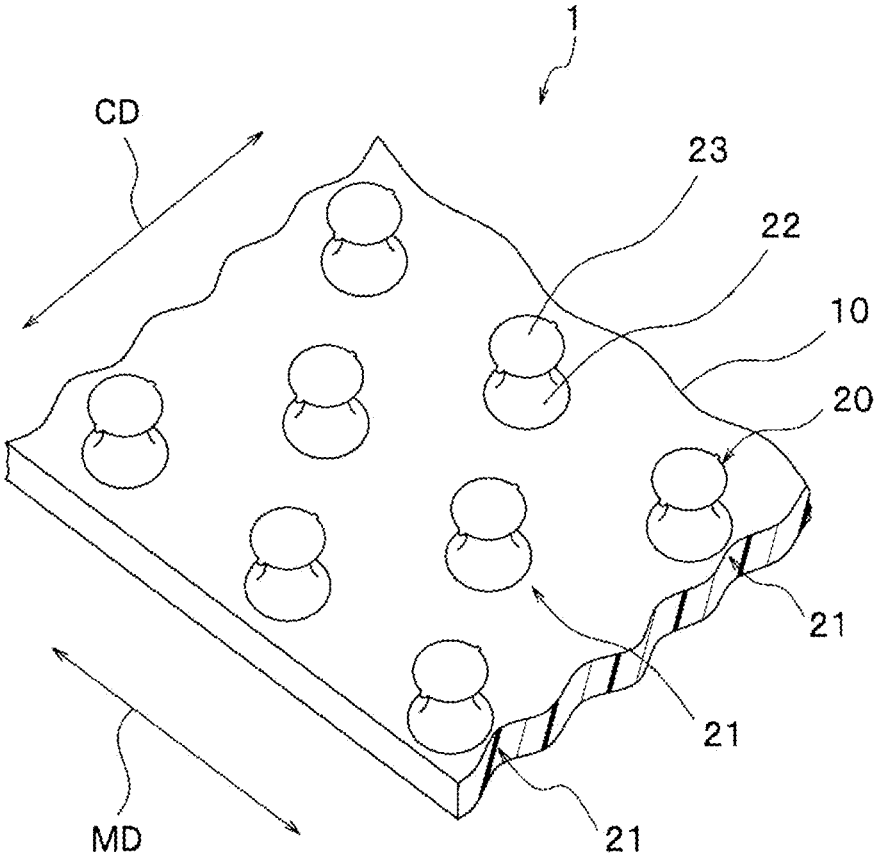
FIG. 1 is a perspective view of a surface fastener according to an embodiment of the present invention.
Figure 2:
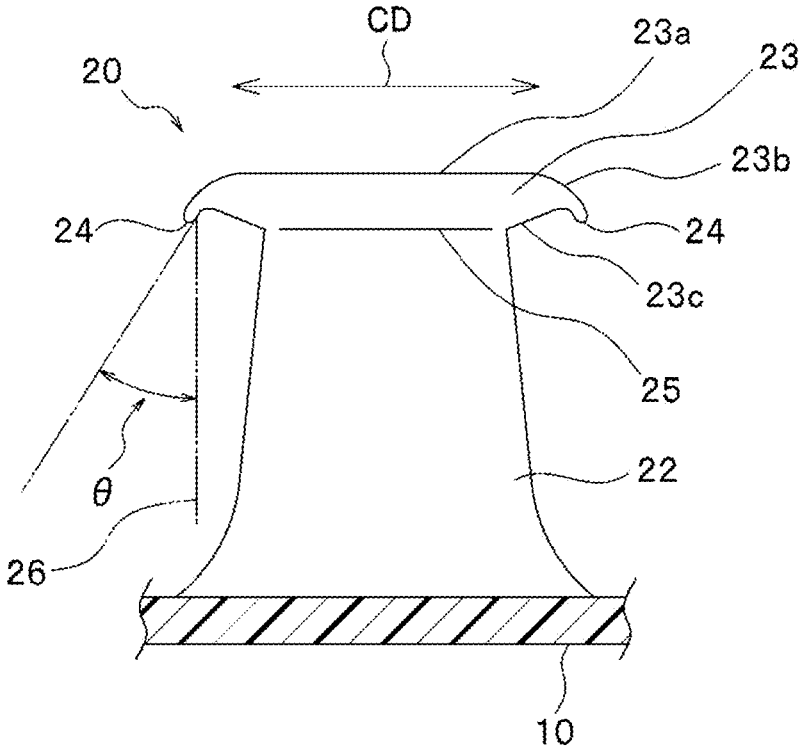
FIG. 2 is a front view of an engaging element of the surface fastener illustrated in FIG. 1, as viewed from a machine direction.

FIG. 1 is a perspective view of a surface fastener according to this embodiment. FIG. 2 is a front view of an engaging element of the surface fastener illustrated in FIG. 1, as viewed from a machine direction. FIGS. 1 and 2 schematically illustrate the surface fastener for ease of understanding the shape of the engaging elements of this embodiment. Hence, the dimensions, size, and the like may be different from those of a surface fastener actually manufactured.

In the following description, the front-rear direction corresponds to the length direction of the surface fastener formed to have a large length. The front-rear direction corresponds to a direction parallel to a machine direction MD, in which the surface fastener or a primary molded body is transported in the process of manufacturing the surface fastener.

The left-right direction corresponds to the width direction perpendicular to the length direction and parallel to a flat upper surface and lower surface of the base portion of the surface fastener. The left-right direction and the width direction are directions parallel to a cross direction CD perpendicular to the machine direction MD.

The upper-lower direction corresponds to the height direction parallel to a direction perpendicular to the upper surface and the lower surface of the base portion or a thickness direction of the base portion, and is a direction perpendicular to the front-rear direction and the left-right direction. In the upper-lower direction, the side to which the engaging element protrudes with respect to the base portion is defined as the upper side, and the side opposite thereto is defined as the lower side.

The surface fastener 1 of this embodiment is manufactured to have a large length in the machine direction MD of a manufacturing apparatus 40 in plan view of the surface fastener 1 by using the manufacturing apparatus 40 having a primary molding device 50 and a heating and pressing device (secondary molding device) 60 illustrated in FIG. 3 as described below. The length dimension (the dimension in the machine direction MD) and the width dimension (the dimension in the cross direction CD) of the surface fastener 1 are not particularly limited, and can be arbitrarily changed by, for example, cutting the surface fastener 1.

The surface fastener 1 of this embodiment is made of a thermoplastic resin having a tensile modulus of 700 MPa or more and 2300 MPa or less. In this case, as the synthetic resin used for forming the surface fastener 1, a thermoplastic resin such as a polyolefin resin, a polyamide resin, a polyester resin, a PVC resin, an ABS resin, or a copolymer thereof may be used. In the present invention, the synthetic resin used for forming the surface fastener 1 is not particularly limited as long as it has a tensile modulus in the above-described range.

The surface fastener 1 has a thin, flat plate-shaped base portion 10 and a plurality of mushroom-shaped engaging elements 20 provided on the upper surface of the base portion 10. The base portion 10 is formed to have a large length in the machine direction MD at the time of manufacturing the surface fastener 1. The base portion 10 has a predetermined thickness that provides an appropriate strength. The base portion 10 has a flat upper surface (first surface) and a flat lower surface (second surface) disposed on the opposite side from the upper surface. The upper surface and the lower surface of the base portion 10 are formed parallel to each other.

The plurality of engaging elements 20 are provided on the upper surface of the base portion 10 so as to be regularly arranged in a staggered arrangement pattern. Specifically, the engaging elements 20 are arranged at a constant pitch (interval) in the front-rear direction, forming a row of the engaging elements 20. A plurality of rows of engaging elements 20 are arranged at regular intervals in the left-right direction. The plurality of engaging elements 20 are provided in a staggered arrangement pattern in which the positions of the engaging elements 20 are shifted by a size of ½ pitch in the front-rear direction, between the rows of the engaging elements 20 adjacent to each other in the left-right direction, such that the engaging elements 20 are arranged alternately or in a zigzag manner. In the present invention, the arrangement of the engaging elements 20 is not particularly limited, and for example, the plurality of engaging elements 20 may be provided in a lattice arrangement pattern in which the engaging elements 20 are aligned in the front-rear direction and the left-right direction, or may be provided at random.

Each of the engaging elements 20 includes a stem portion 22 standing upright from the base portion 10, an engaging head portion 23 provided on top of the stem portion 22, and two engaging pawl portions (engaging portions) 24 protruding outward from an outer circumference portion of the engaging head portion 23.

The stem portion 22 is formed so as to extend in a direction perpendicular to the upper surface of the base portion 10. The stem portion 22 has a truncated cone shape or a substantially truncated cone shape in which the area of the cross section perpendicular to the upper-lower direction gradually increases toward the base portion 10. Herein, the substantially truncated cone means a shape similar to a truncated cone. In the present invention, the shape of the stem portion 22 is not limited, and the stem portion 22 may be formed in a truncated pyramid shape such as a truncated quadrangular pyramid shape, a columnar shape, a prism shape such as a quadrangular prism shape, or a shape similar thereto.

The engaging head portion 23 is formed on top of the stem portion 22, integrally with the stem portion 22 via a boundary portion 25. In this case, the boundary portion 25 between the stem portion 22 and the engaging head portion 23 can also be referred to as the upper end of the stem portion 22. The engaging head portion 23 forms the top end portion of the engaging element 20 and has a shape protruding outward in the radial direction of the engaging head portion 23 from the entire circumference of the boundary portion 25. The engaging head portion 23 has a disc shape or a dish shape. Specifically, the engaging head portion 23 has a relatively small thickness dimension (dimension in the upper-lower direction) and has a circular shape in plan view of the engaging element 20 viewed from above.

As illustrated in FIG. 2, the engaging head portion 23 has a head top surface 23*a* facing upward, a head back surface 23*c* extending outward in the radial direction from the boundary portion 25 with the stem portion 22, and a head outer-circumferential side surface 23*b* formed continuously from the outer circumference portion of the head top surface 23*a* to the outer circumference portion of the head back surface 23*c*.

The head top surface 23*a* of the engaging head portion 23 includes a flat surface provided and formed parallel to the upper surface of the base portion 10. The head back surface 23*c* is disposed on the opposite side from the head top surface 23*a* in the upper-lower direction so as to face the base portion 10. The head outer-circumferential side surface 23*b*, except for portions where the engaging pawl portions 24 are formed, faces outward in the radial direction of the engaging head portion 23 and is formed in a curved shape bent from the head top surface 23*a* toward the head back surface 23*c*.

Each of the engaging elements 20 is provided with a pair of fine, right and left engaging pawl portions 24 protruding outward from the outer circumference portion of the engaging head portion 23. The left and right engaging pawl portions 24 are arranged in a point-symmetrical positional relationship with each other in plan view of the engaging element 20, and protrude outward in the radial direction of the engaging head portion 23 from the engaging head portion 23. In particular, in the case of this embodiment, the left and right engaging pawl portions 24 protrude in opposite directions along the left-right direction (cross direction CD) from the central portion of the engaging head portion 23 in the machine direction MD.

As illustrated in FIG. 2, each of the left and right engaging pawl portions 24 has a shape protruding obliquely downward toward the base portion 10 from the outer circumference portion of the engaging head portion 23. Each of the engaging pawl portions 24 has a base end portion connected to the engaging head portion 23 and a distal end portion provided on the opposite side from the base end portion in the direction in which the engaging pawl portion 24 protrudes. The engaging pawl portion 24 is formed in a very small size, in which the pawl width dimension at the base end portion thereof is smaller than ½, preferably ⅓, and more preferably ⅕ of the dimension of the boundary portion 25 in the cross direction CD when the engaging element 20 is viewed from the machine direction MD. The pawl width dimension at the base end portion of the engaging pawl portion 24 means the maximum value of the dimension of the base end portion of the engaging pawl portion 24 in the circumferential direction of the engaging head portion 23.

In front view of the engaging element 20 viewed from the machine direction MD (FIG. 2), the engaging pawl portions 24 have pawl upper surfaces facing up and pawl back surfaces facing the base portion 10. In the engaging pawl portions 24, the pawl back surfaces are disposed on the opposite side from the pawl upper surfaces in the upper-lower direction. The pawl back surfaces of the engaging pawl portions 24 are formed such that the inclination angle θ at which the pawl back surfaces are inclined with respect to a virtual vertical line 26 extending in the upper-lower direction is 70° or less in front view mentioned above. At this time, the pawl upper surfaces are positioned below the upper surface of the engaging head portion 23.

By setting the inclination angle θ of the pawl back surfaces to 70° or less, loops of a loop member (not illustrated) are stably held by the engaging pawl portions 24 when the loops of the loop member are hooked on the engaging elements 20 of the surface fastener 1 to engage the surface fastener 1 with the loop member. Furthermore, the hooked loops are less likely to be disengaged from the engaging pawl portions 24.

Furthermore, by setting the inclination angle θ of the pawl back surfaces to 70° or less, deterioration of the texture of the surface fastener 1 due to the provision of the engaging pawl portions 24 can be suppressed. Specifically, it has been newly confirmed that there is a correlation between the texture felt when the skin of a person touches the upper surface of the surface fastener 1 (the surface on the side of the surface fastener 1 on which the engaging elements 20 are disposed) and the coefficient of friction of the upper surface of the surface fastener 1, as will be described below. Regarding this correlation, by setting the inclination angle θ of the pawl back surfaces to 70° or less as described above, the pawl upper surfaces are positioned below the upper surface of the engaging head portion 23. Thus, it is possible to suppress an increase in the coefficient of friction of the upper surface of the surface fastener 1 due to the provision of the engaging pawl portions 24. Accordingly, the surface fastener 1 is likely to have a smooth and good texture.

Meanwhile, the inclination angle θ of the pawl back surfaces of the engaging pawl portions 24 is preferably 10° or more. By setting the inclination angle θ to 10° or more, the loops of the loop member can easily enter the back side of the engaging pawl portions 24, and the loops can be easily hooked on the engaging pawl portions 24.

The surface fastener 1 of this embodiment is formed such that the total of the areas of the engaging head portions 23 per 1 $cm^2$ of the surface fastener 1 is 10,000,000 $\mu m^2$ or more, and more preferably 16,000,000 $\mu m^2$ or more, in plan view of the surface fastener 1 as viewed from above. That is, in this embodiment, regarding the plurality of engaging elements 20 arranged per 1 $cm^2$ of the surface fastener 1, the total value of the areas of the engaging head portions 23 of the engaging elements 20 recognized in plan view of the surface fastener 1 is 10,000,000 $\mu m^2$ or more.

The total value of the areas of the engaging head portions 23 of the engaging elements 20 includes a value obtained by obtaining the area of the engaging head portion 23 of each of the engaging elements 20 arranged per 1 $cm^2$, and summing all of the obtained area of each of the engaging head portions 23 of the engaging elements 20. The total value also includes a value obtained by, for example, calculating the average value of the areas of the engaging head portions 23 of the plurality of engaging elements 20, and multiplying the average value of the areas by the number of engaging elements 20 arranged per 1 $cm^2$ (i.e., the formation density of the engaging elements 20). The area of the engaging head portion 23 of each engaging element 20 can be obtained from, for example, image data obtained by photographing the surface fastener 1 from above. When the engaging head portions 23 of the engaging elements 20 have a circular shape or an elliptical shape in plan view of the surface fastener 1, the area of each engaging head portion 23 can be calculated from the diameter of the engaging head portion 23.

Furthermore, in the present invention, the total of the areas of the engaging head portions 23 per 1 $cm^2$ of the surface fastener 1 is set to 10,000,000 $\mu m^2$ or more. In order to achieve this, for example, the surface fastener 1 may be formed with a high formation density of the engaging elements 20 and a small area of the engaging head portion 23 in one engaging element 20. Alternatively, the surface fastener 1 may be formed with a large area of the engaging head portion 23 in one engaging element 20 and a low formation density of the engaging elements 20.

In this embodiment, by setting the total of the areas of the engaging head portions 23 of the engaging elements 20 arranged per 1 $cm^2$ to 10,000,000 $\mu m^2$ or more, which is large, as described above, a contactor of a friction testing machine described below can be smoothly moved with respect to the upper surface of the surface fastener 1 when, for example, the coefficient of friction of the upper surface of the surface fastener 1 is measured by using the friction testing machine. This can reduce the fluctuation in coefficient of friction of the surface fastener 1 measured with the friction testing machine.

Here, the relationship between the texture and the coefficient of friction of the surface fastener will be described. As a result of performing various experiments, examinations, and studies on the texture of the upper surface side of the surface fastener on which a plurality of engaging elements are arranged and the coefficient of friction of the upper surface side of the surface fastener, it was found that there is a correlation between the texture felt when the upper surface side of the surface fastener is rubbed against the skin of an examinee at a position that cannot be viewed by the examinee and the fluctuation in coefficient of friction when the coefficient of friction of the upper surface of the surface fastener 1 is measured. Specifically, for various types of surface fasteners, the superiority/inferiority of the texture felt by the examinees and the result of the coefficient of friction measured with the surface fastener were compared. As a result, it was confirmed that the surface fasteners that many examinees felt were superior in texture tend to have smaller fluctuations in the measured coefficient of friction (specifically, the fluctuation in coefficient of friction was 0.06 or less), and the surface fasteners that many examinees felt were inferior in texture tend to have larger fluctuations in the measured coefficient of friction.

Therefore, in the surface fastener 1 of this embodiment, by setting the total of the areas of the engaging head portions 23 of the engaging elements 20 arranged per 1 $cm^2$ to 10,000,000 $\mu m^2$ or more as described above, it is possible to keep the fluctuation in the coefficient of friction of the surface fastener 1 small. Thus, a user who touches the surface fastener 1 can easily feel a good texture.

Meanwhile, in the surface fastener 1 of this embodiment, the total of the areas of the engaging head portions 23 of the engaging elements 20 arranged per 1 $cm^2$ is preferably 50,000,000 $\mu m^2$ or less, and more preferably 35,000,000 $\mu m^2$ or less. By setting the total value of the areas of the engaging head portions 23 per 1 $cm^2$ to 50,000,000 $\mu m^2$ or less, it is possible to easily secure, between two adjacent engaging elements 20, an appropriate gap into which the loop of the loop member can be inserted. This enables the loops of the loop member to be stably engaged with the engaging elements 20 of the surface fastener 1 when the surface fastener 1 is laid on the loop member.

In this embodiment, the formation density of the engaging elements 20 of the surface fastener 1 is 300 number/$cm^2$ or more, and preferably 400 number/$cm^2$ or more. By setting the formation density of the engaging elements 20 to 300 number/$cm^2$ or more, the total value of the areas of the engaging head portions 23 of the engaging elements 20 arranged per 1 $cm^2$ can be easily made 10,000,000 $\mu m^2$ or more, as described above. This makes it easy to improve the texture of the surface fastener 1.

Furthermore, in this embodiment, the synthetic resin used for forming the surface fastener 1 has a tensile modulus of 700 MPa or more and 2300 MPa or less, as described above.

Because the synthetic resin has a tensile modulus of 700 MPa or more, the engaging elements 20 have a proper rigidity (strength). Therefore, it is possible to improve the peel strength of the surface fastener 1 with respect to the loop member. In addition, in manufacturing the surface fastener 1, primary elements 31 are heated and pressed in a secondary molding step described below. At this time, the occurrence of abrupt deformation of the primary elements 31 due to the pressing is suppressed, thus stabilizing the shape of the engaging elements 20.

Because the synthetic resin has a tensile modulus of 2300 MPa or less, it is possible to deform the primary elements 31 appropriately and quickly in the secondary molding step. This makes it possible to stably form the thin, disc-shaped engaging head portions 23 and to stably provide the engaging head portions 23 with the engaging pawl portions 24 with the pawl back surfaces having an inclination angle θ of 70° or less. This makes it easy for the surface fastener 1 to have high peel strength with respect to the loop member and to have a good texture.

Next, a method for manufacturing the surface fastener 1 of the above-described embodiment will be described.

Figure 3:
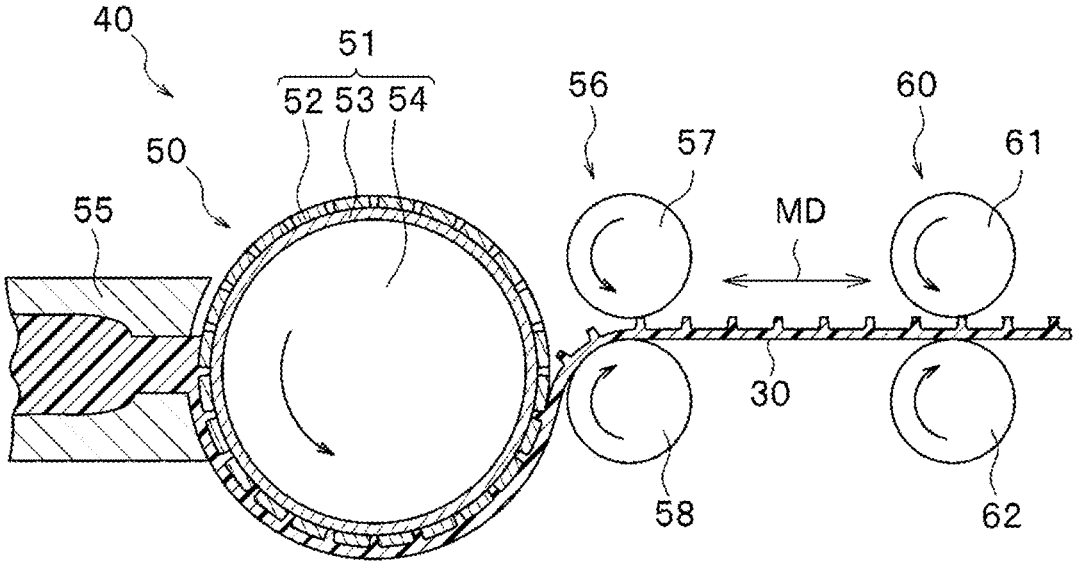
FIG. 3 is a schematic view illustrating a manufacturing apparatus for manufacturing the surface fastener illustrated in FIG. 1.
Figure 4:
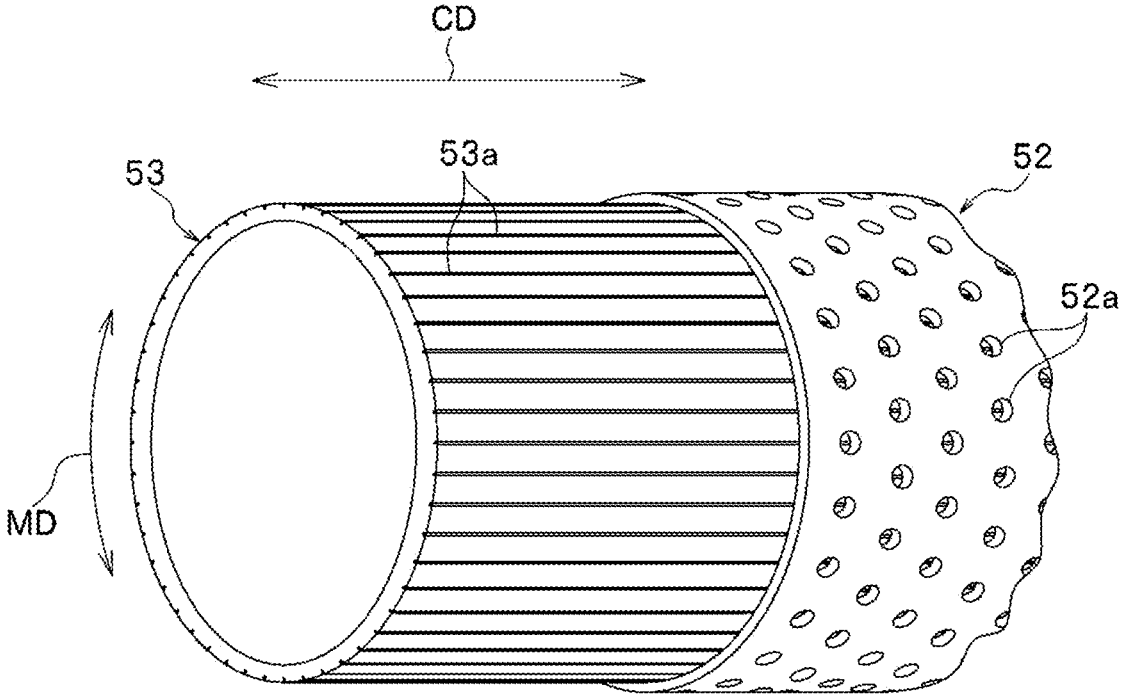
FIG. 4 is a perspective view schematically illustrating an outer cylindrical body and an inner cylindrical body disposed in a primary molding device of the manufacturing apparatus illustrated in FIG. 3.
Figure 5:
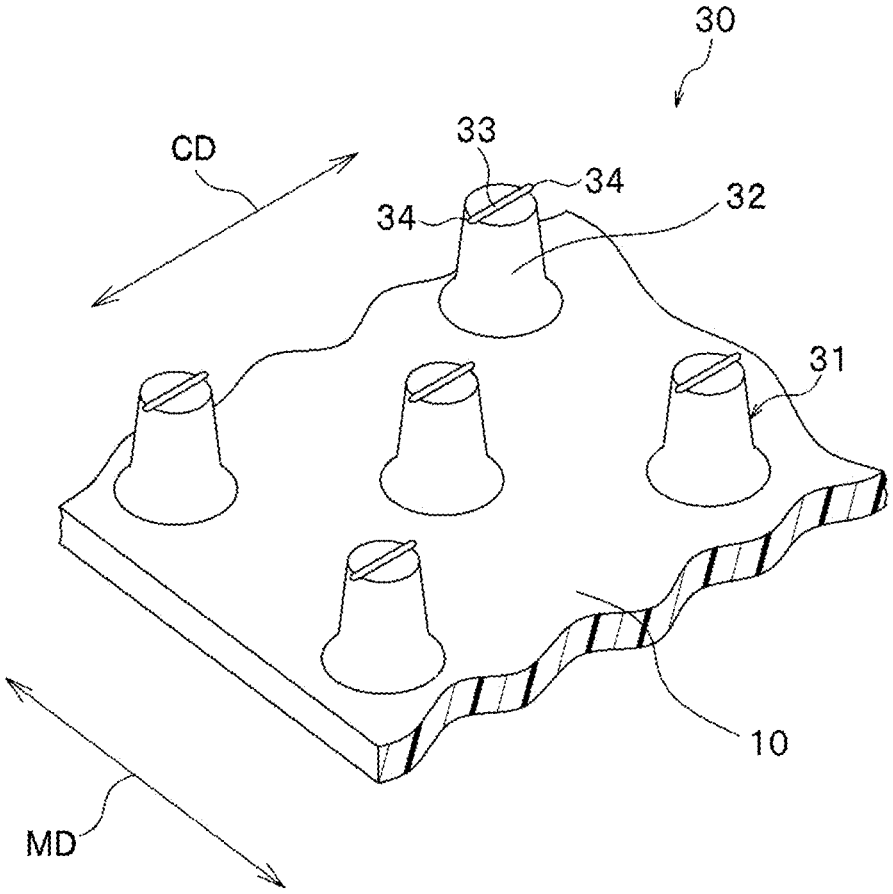
FIG. 5 is a perspective view schematically illustrating a primary molded body molded in a primary molding step.

The surface fastener 1 illustrated in FIGS. 1 and 2 is manufactured by using a manufacturing apparatus 40 illustrated in FIG. 3. The manufacturing apparatus 40 includes a primary molding device 50 that performs a primary molding step, and a heating and pressing device (secondary molding device) 60 that performs a secondary molding step for pressing and molding the primary molded body 30 molded in the primary molding step.

The primary molding device 50 includes a die wheel 51 that is rotationally driven in one direction (counterclockwise in the drawing), a supply nozzle part 55 that is disposed so as to face the circumferential surface of the die wheel 51 and continuously supplies a molten synthetic resin material, and a pickup roller 56 disposed on the downstream side of the supply nozzle part 55 in the rotation direction of the die wheel 51.

The die wheel 51 includes an outer cylindrical body (outer sleeve) 52 having a cylindrical shape and serving as a die, an inner cylindrical body (inner sleeve) 53 having a cylindrical shape and disposed inside the outer cylindrical body 52 so as to be in close contact therewith, and a rotary driving roller 54 that rotate the outer cylindrical body 52 and the inner cylindrical body 53 in one direction. A cooling jacket (not illustrated) through which a cooling liquid is circulated is provided inside the rotary driving roller 54.

The outer cylindrical body 52 is provided with a plurality of through-holes 52*a* extending from the outer circumferential surface to the inner circumferential surface of the outer cylindrical body 52, the through-holes serving as cavities for forming primary stem portions 32, which will be described below, of the primary molded body 30. Each of the through-holes 52*a* has a truncated cone shape or a substantially truncated cone shape in which the circular shape thereof at the outer circumferential surface of the outer cylindrical body 52 is larger than the circular shape thereof at the inner circumferential surface of the outer cylindrical body 52.

The outer circumferential surface of the inner cylindrical body 53 is provided with a plurality of grooves (recesses) 53*a*. The grooves 53*a* are formed linearly along the direction parallel to the center axis of the inner cylindrical body 53 (cross direction CD) and in such a size that a molten synthetic resin can flow in. The grooves 53*a* are formed at regular intervals along the circumferential direction (machine direction MD) of the inner cylindrical body 53. At least some of the grooves 53*a* in the inner cylindrical body 53 are provided so as to intersect the outer circumferential edges of the through-holes 52*a* provided in the inner circumferential surface of the outer cylindrical body 52 when the die wheel 51 is assembled.

In the present invention, the material, size, and the method for forming the outer cylindrical body 52 and the inner cylindrical body 53 are not particularly limited. Furthermore, the outer circumferential surface of the inner cylindrical body 53 may be provided with a plurality of recesses that differ in shape and size from those of the groove 53*a*. Moreover, the die wheel 51 may not include the inner cylindrical body 53, and the outer cylindrical body 52 may be directly attached to the rotary driving roller 54. In that case, it is preferable that the inner circumferential surface of the outer cylindrical body 52 or the surface of the rotary driving roller 54 with which the outer cylindrical body 52 comes into contact is provided with recesses connected to the outer circumferential edges of the through-holes 52*a*.

The pickup roller 56 includes a pair of an upper nip roller 57 and a lower nip roller 58 that nip the primary molded body 30 molded by the outer circumferential surface of the die wheel 51 from above and below and pull the primary molded body 30. The upper nip roller 57 and the lower nip roller 58 are each provided with, on the outer circumferential surfaces thereof, a surface layer (not illustrated) made of an elastomer such as a polyurethane elastomer.

The heating and pressing device 60 includes a pair of upper and lower pressing rollers (calender rollers) 61 and 62 disposed on the downstream side of the pickup roller 56. The upper pressing roller 61 and the lower pressing roller 62 are disposed so as to face each other with a predetermined gap therebetween. The gap between the upper pressing roller 61 and the lower pressing roller 62 can be adjusted by a height adjusting means (not illustrated).

The upper pressing roller 61 has a heating source (not illustrated) therein so as to be able to control the surface temperature (heating temperature) of the upper pressing roller 61, that is, so as to be able to set the heating temperature of the upper pressing roller 61 to a required temperature. In the present invention, the structure of the heating and pressing device 60 is not particularly limited as long as the heating and pressing device 60 includes the upper pressing roller 61 that comes into contact with the primary elements 31 (described below) of the primary molded body 30 to apply heat and pressure to at least some of the primary elements 31.

When the surface fastener 1 is manufactured by using the manufacturing apparatus 40 having the primary molding device 50 and the heating and pressing device 60 as described above, first, a primary molding step for molding the primary molded body 30 by using the primary molding device 50 is performed. In the primary molding step, the molten thermoplastic resin is continuously supplied from the supply nozzle part 55 toward the outer circumferential surface of the rotating die wheel 51. At this time, as described above, a synthetic resin having a tensile modulus of 700 MPa or more and 2300 MPa or less is used as the thermoplastic resin supplied from the supply nozzle part 55 to the die wheel 51.

By supplying the molten synthetic resin from the supply nozzle part 55 to the die wheel 51, the base portion 10 continuously extending in the machine direction MD is formed between the supply nozzle part 55 and the die wheel 51. While the base portion 10 is being molded, the plurality of primary elements 31 are molded integrally with the base portion 10 by the outer cylindrical body 52 and the inner cylindrical body 53 of the die wheel 51.

The primary molding device may be formed to have a structure in which a molten synthetic resin material is supplied from the supply nozzle part toward a gap between two opposing die wheels, for example. In that case, the base portion 10 is formed between the pair of die wheels, and the primary elements 31 are formed by cavities provided in one of the die wheels.

The primary molded body 30 molded by the primary molding device 50 includes the base portion 10 and the plurality of primary elements 31 protruding from the upper surface of the base portion 10. The base portion 10 of the primary molded body 30 serves as the base portion 10 of the surface fastener 1. The primary elements 31 are deformed into the engaging elements 20 by being pressed and molded in the secondary molding step. Each of the primary elements 31 has a primary stem portion 32 in a truncated cone shape or a substantially truncated cone shape standing upright from the base portion 10, a bar-shaped rib portion 33 swelling upward from the upper surface of the primary stem portion 32, and two protrusions (primary engaging pawl portions) 34 formed integrally with the rib portion 33 and protruding outward from the primary stem portion 32.

The primary element 31 may not have the bar-shaped rib portion 33 swelling upward from the upper surface of the primary stem portion 32. In that case, the primary element 31 includes two protrusions (primary engaging pawl portions) 34 protruding outward from the outer circumferential edge of the primary stem portion 32 at the upper end of the primary stem portion 32.

The rib portion 33 and the protrusions 34 of the primary element 31 are formed by allowing a synthetic resin to flow from the through-hole 52*a* in the outer cylindrical body 52 into the groove 53*a* provided in the inner cylindrical body 53 and to enter portions beyond the through-hole 52*a* along the groove 53*a* in the primary molding step. In this case, the rib portion 33 is locally formed on the upper surface of the primary stem portion 32 along the cross direction CD. The two protrusions 34 protrude outward in the left-right direction from the ends of the rib portion 33.

In the primary molding step, the molten synthetic resin held on the outer circumferential surface of the die wheel 51 is cooled while the die wheel 51 makes a half turn, and thus is cured. In this way, the primary molded body 30 is molded. Thereafter, the primary molded body 30 is continuously peeled off from the outer circumferential surface of the die wheel 51 by the pickup roller 56. At this time, the protrusions 34 of the primary molded body 30 are smoothly pulled out from the grooves 53*a* in the inner cylindrical body 53 and the through-holes 52*a* in the outer cylindrical body 52 while being elastically deformed.

Next, the primary molded body 30 peeled off from the die wheel 51 is transported toward the heating and pressing device 60 that performs the secondary molding step, and is introduced between the upper pressing roller 61 and the lower pressing roller 62 of the heating and pressing device 60. In the secondary molding step, the base portion 10 of the primary molded body 30 is supported from below by the lower pressing roller 62. Furthermore, by bringing the upper pressing roller 61 into contact with the upper ends the primary elements 31 while rotating the upper pressing roller 61, the upper pressing roller 61 heats at least the upper ends of the primary elements 31 to a required temperature to soften the upper ends and presses the primary elements 31 from above.

At this time, the synthetic resin forming the primary molded body 30 has a tensile modulus of 700 MPa or more and 2300 MPa or less. Hence, by performing heating and pressing in the secondary molding step on the primary elements 31, it is possible to appropriately thermally deform the upper ends of the primary stem portions 32, the rib portions 33, and the protrusions 34 of the primary elements 31 in a short time. As a result, it is possible to stably form the thin engaging head portions 23 having flat surfaces at the upper surfaces and the fine engaging pawl portions 24 protruding obliquely downward from the engaging head portions 23. Thus, the surface fastener 1 of this embodiment, as illustrated in FIGS. 1 and 2, is manufactured.

Thereafter, the manufactured surface fastener 1 having a large length in the machine direction is transported toward a cutting section (not illustrated) and is cut into a predetermined length by the cutting section and is collected. Alternatively, the surface fastener 1 in a long state is wound and collected in a roll by a collecting roller or the like.

In the present invention, the method, the manufacturing apparatus, and the like for manufacturing the surface fastener 1 are not particularly limited.

In the surface fastener 1 of this embodiment manufactured as described above, the plurality of engaging elements 20 are provided at a formation density of 300 number/$cm^2$ or more. Furthermore, the total of the areas of the engaging head portions 23 of 300 or more engaging elements 20 arranged per 1 $cm^2$ is 10,000,000 $\mu m^2$ or more. Because this makes it possible to keep the fluctuation in coefficient of friction on the upper surface side of the surface fastener 1 small, a user can easily feel a good texture when touching the surface fastener 1 at the side on which the engaging elements 20 are arranged.

Furthermore, as described above, the surface fastener 1 of this embodiment is made of a synthetic resin having a tensile modulus of 700 MPa or more and 2300 MPa or less. Hence, it is possible to appropriately provide two fine engaging pawl portions 24, protruding obliquely downward toward the base portion 10 at an inclination angle of 70° or less, on the outer circumference portion of each of the thin engaging head portions 23 having a large area.

For example, in a conventional surface fastener, if the total of the areas of the engaging head portions per unit area is increased, when the surface fastener is pressed against a loop member to engage therewith, it is difficult to insert the engaging elements having large engaging head portions or the engaging elements arranged at a high formation density deep between the loops of the loop member. As a result, the peel strength (engagement strength) of the surface fastener with respect to the loop member may be lowered.

In contrast, in the surface fastener 1 of this embodiment, because the tensile modulus of the synthetic resin is in the predetermined range as described above, it is possible to appropriately provide the engaging head portions 23 with the fine engaging pawl portions 24. Thus, the loops of the loop member can be hooked on the engaging pawl portions 24 of the engaging elements 20. Furthermore, the loops hooked on the engaging pawl portions 24 are unlikely to be disengaged. Therefore, even when the total of the areas of the engaging head portions 23 per unit area in the surface fastener 1 is increased as described above, the peel strength of the surface fastener 1 suitable for use in disposable diapers, diaper covers, and the like can be easily ensured.

Examples

The present invention will be described in more detail below with reference to examples.

(Manufacture of Surface Fastener)

The surface fasteners 1 as Examples 1 to 6 and Comparative Examples 1 to 4 were manufactured using the manufacturing apparatus 40 described in the above-described embodiment.

Specifically, in Examples 1 to 6 and Comparative Examples 1 to 4, the primary molded bodies 30 were produced by performing the primary molding step with the primary molding device 50, using polypropylenes having tensile moduli shown in Tables 1 and 2 below as the synthetic resin used for forming the surface fastener 1. Thereafter, the thus-obtained primary molded bodies 30 were subjected to the secondary molding step with the heating and pressing device 60, and thus, the surface fasteners 1 of Examples 1 to 3 were manufactured. Note that the polypropylenes include a homopolymer, a random copolymer, and a block copolymer.

In addition, in Examples 1 to 6 and Comparative Examples 1 to 4, the surface fasteners 1 were manufactured such that at least one of the area of the engaging head portion 23 of each engaging element 20 and the formation density of the engaging elements 20 are different from one another.

(Measurement of Total Value of Areas of Engaging Head Portions Per 1 $cm^2$)

For each of the manufactured surface fasteners 1 of Examples 1 to 6 and Comparative Examples 1 to 4, image data was acquired by photographing the surface fastener 1 from above, and the area of the engaging head portion 23 in plan view of the surface fastener 1 was obtained using the acquired image data. Specifically, using the above-described image data of the surface fastener 1, for a plurality of engaging elements 20 (for example, 10 or more engaging elements 20) of the surface fastener 1, the area of the engaging head portion 23 of each engaging element 20 was measured by means of image analysis, and the average value of the area of the engaging head portion 23 of one engaging element 20 was calculated.

Subsequently, using the above-described image data, the formation density of the engaging elements 20 per 1 $cm^2$ was measured at a plurality of portions of the surface fastener 1, and the average value of the formation density was calculated. Furthermore, by multiplying the calculated average value of the areas of the engaging head portions 23 by the average value of the formation densities of the engaging elements 20, the total value of the areas of the engaging head portions 23 of the engaging elements 20 arranged per 1 $cm^2$ was calculated for the surface fasteners 1 of Examples 1 to 6 and Comparative Examples 1 to 4. The calculation results are shown in Tables 1 and 2 below.

(Inclination Angle θ of Pawl Back Surface of Engaging Pawl Portion)

For each of the manufactured surface fasteners 1 of Examples 1 to 6 and Comparative Examples 1 to 4, the engaging elements 20 were photographed from one side (front side) in the machine direction MD. Furthermore, the inclination angle θ of the pawl back surfaces of the engaging pawl portions 24 was measured from the photographed image of the engaging element 20. For the respective surface fasteners 1, the values of the measured inclination angle θ are shown in Tables 1 and 2 below.

(Measurement of Fluctuation in Coefficient of Friction)

Figure 6:
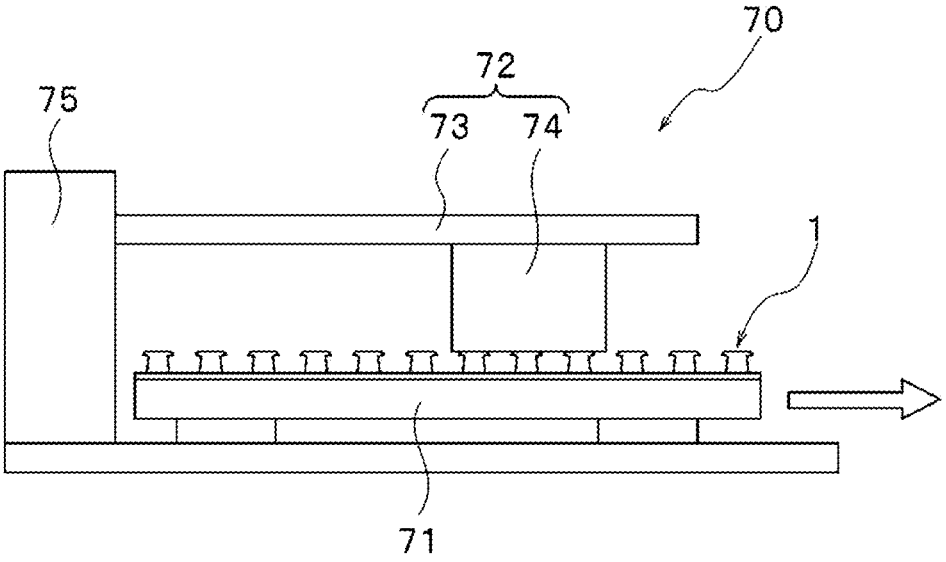
FIG. 6 is a diagram illustrating a friction test of the surface fastener.

A friction test for measuring the coefficient of friction was performed on each of the surface fasteners 1 of Examples 1 to 6 and Comparative Examples 1 to 4 using a friction testing machine 70 illustrated in FIG. 6.

The friction testing machine 70 includes a movable work stage 71 to which the surface fastener 1 is to be fixed, a contactor 72 to be brought into contact with the upper surface of the surface fastener 1 on which the engaging elements 20 are provided, and a detector 75 for measuring the frictional force between the surface fastener 1 and the contactor 72. The contactor 72 has a resin arm 73 extending from the detector 75, and a silicone foam plug 74, which simulates human skin, attached to the resin arm 73. The silicone foam plug 74 is formed in a cylindrical shape, and a contact surface of the silicone foam plug 74 with the surface fastener 1 is formed in a circular shape. The silicone foam plug 74 has a weight of 10 g or more and 15 g or less.

In the friction test, each of the surface fasteners 1 of Examples 1 to 6 and Comparative Examples 1 to 4 was cut to a size of 25 mm in the machine direction MD×45 mm in the cross direction CD, and the cut piece of the cut surface fastener 1 was fixed to the work stage 71 of the friction testing machine with a double-sided tape. At this time, the surface fastener 1 was fixed to the work stage 71 in such an orientation that the contactor 72 of the friction testing machine moves in the cross direction CD on the surface fastener 1. The contactor 72 of the friction testing machine 70 was set so as to be placed on the surface fastener 1 fixed to the work stage 71 in a well-balanced manner. At this time, the surface fastener 1 was subjected to the weight of the silicone foam plug 74 from the silicone foam plug 74.

In the friction testing machine 70, the work stage 71 was moved at a speed of 1 mm/sec in the cross direction of the surface fastener 1 in a state in which the surface fastener 1 and the contactor 72 are set in the above-described manner, and the detector 75 measured the frictional force at the time when the work stage 71 was moving. In this measurement of the frictional force, the work stage 71 was moved by 30 mm. In the analysis, the coefficient of kinetic friction was obtained from the measured frictional force using the data obtained for a moving distance of 5 mm to 25 mm, and the fluctuation in the coefficient of kinetic friction in the analysis section was calculated.

The fluctuations in the coefficient of kinetic friction calculated for the surface fasteners 1 of Examples 1 to 6 and Comparative Examples 1 to 4 are shown in Tables 1 and 2 below. In this friction test, based on the results of examinations and studies on the correlation between the texture of the surface fastener 1 and the fluctuation in the coefficient of friction of the surface fastener 1, the surface fasteners 1 with a fluctuation in the coefficient of friction of 0.06 or less were evaluated as the surface fasteners 1 having a good texture.

(Measurement of Peel Strength)

Figure 7:
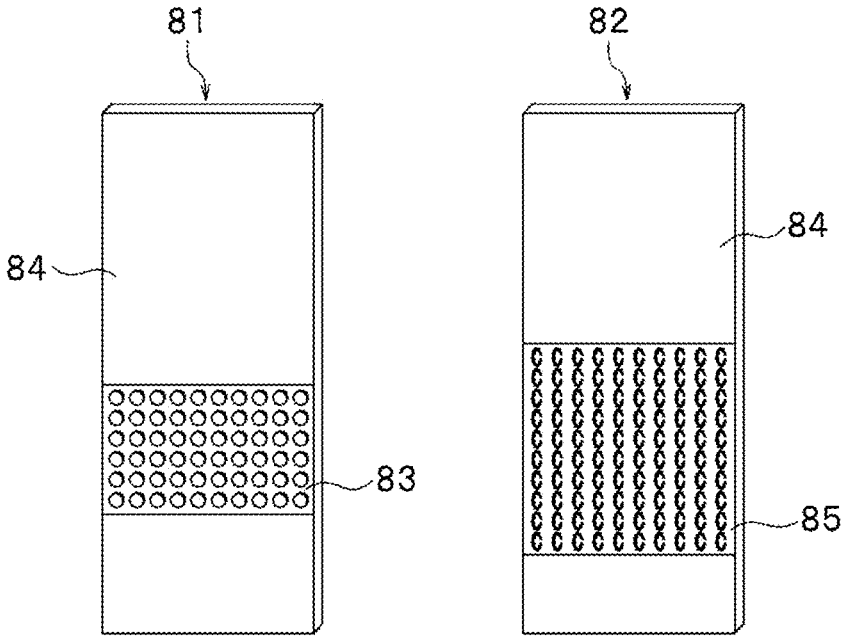
FIG. 7 schematically illustrates test pieces used for a peel strength test of the surface fastener.

In the peel strength test, as illustrated in FIG. 7, each of the surface fasteners 1 of Examples 1 to 6 and Comparative Examples 1 to 4 was cut to a size of 25 mm in the machine direction MD×25 mm in the cross direction CD, and a cut piece 83 of the cut surface fastener 1 was bonded to a support member 84 made of a piece of nonwoven fabric 85 to prepare a first test piece 81 on the surface fastener 1 side. Furthermore, a piece of nonwoven fabric 85 having a size in the machine direction MD larger than that of the cut piece 83 of the surface fastener 1 was bonded to a support member 84 to prepare a second test piece 82 on the loop member side.

Figure 8:
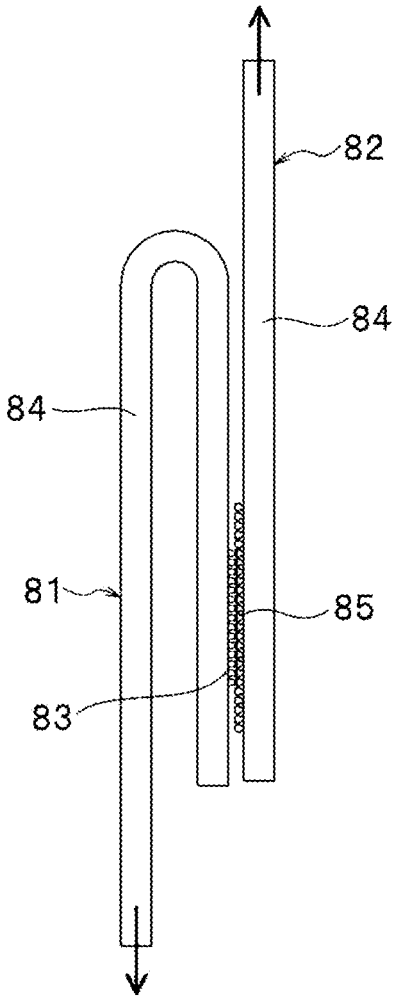
FIG. 8 is a diagram illustrating the peel strength test.

Next, as illustrated in FIG. 8, the cut piece 83 of the surface fastener 1 of the first test piece 81 was engaged with the second test piece 82. Then, the second test piece 82 was folded back in a U-shape. Subsequently, the first test piece 81 and the second test piece 82 were each gripped by a pair of clampers (not illustrated), and then the pairs of clampers gripping the first test piece 81 and the second test piece 82 were moved in directions away from each other at a constant speed. By doing so, loads were gradually applied to the first test piece 81 and the second test piece 82 in the engaged state.

Then, an integrated average peeling force (N) was obtained from the force applied from when the load starts to be applied to when the first test piece 81 and the second test piece 82 were separated, this value was divided by an effective width (cm) of the surface fastener 1 to obtain the peel strength (N/cm) of the surface fastener 1. This peel strength test was performed on a plurality pieces of each of the surface fasteners 1 of Examples 1 to 6 and Comparative Examples 1 to 4, and the average values of the measured peel strengths were calculated. Tables 1 and 2 below show the average values of the peel strength calculated for the respective surface fasteners 1. In this peel strength test, when the calculated average value of the peel strength was 0.25 N/cm or more, it was evaluated that the surface fastener 1 had a high peel strength.

TABLE 1

| ITEM | UNIT | EXAMPLE 1 | EXAMPLE 2 | EXAMPLE 3 | EXAMPLE 4 | EXAMPLE 5 | EXAMPLE 6 |
|---|---|---|---|---|---|---|---|
| AVERAGE OF AREAS OF ENGAGING HEAD PORTIONS | $\mu m^2$ | 80,000 | 49,000 | 38,000 | 42,000 | 42,000 | 38,000 |
| FORMATION DENSITY OF ENGAGING ELEMENTS | NUMBER/ $cm^2$ | 400 | 400 | 625 | 416.7 | 416.7 | 416.7 |
| AREA OF ENGAGING HEAD PORTIONS PER 1 $cm^2$ | $\mu m^2$ | 32,000,000 | 19,600,000 | 23,800,000 | 17,500,000 | 17,500,000 | 15,800,000 |
| TENSILE MODULUS | MPa | 2050 | 2050 | 2050 | 1650 | 950 | 1700 |
| PAWL ANGLE | DEGREE | 36 | 46 | 32 | 12 | 54 | 30 |
| FLUCTUATION IN COEFFICIENT OF FRICTION | — | 0.028 | 0.026 | 0.026 | 0.039 | 0.044 | 0.051 |
| PEEL STRENGTH | N/cm | 0.34 | 0.50 | 0.60 | 0.67 | 0.33 | 0.54 |

TABLE 2

| ITEM | UNIT | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|
| AVERAGE OF AREAS OF ENGAGING HEAD PORTIONS | $\mu m^2$ | 35,000 | 29,000 | 17,000 | 38,000 |
| FORMATION DENSITY OF ENGAGING ELEMENTS | NUMBER/$cm^2$ | 277.8 | 277.8 | 277.8 | 416.7 |
| AREA OF ENGAGING HEAD PORTIONS PER 1 $cm^2$ | $\mu m^2$ | 9,700,000 | 8,100,000 | 4,700,000 | 15,800,000 |
| TENSILE MODULUS | MPa | 2050 | 2050 | 2050 | 650 |
| PAWL ANGLE | DEGREE | 18 | 32 | 50 | 73 |
| FLUCTUATION IN COEFFICIENT OF FRICTION | — | 0.065 | 0.062 | 0.076 | 0.061 |
| PEEL STRENGTH | N/cm | 0.84 | 0.73 | 0.34 | 0.16 |

As illustrated in Table 1, with the surface fasteners 1 of Examples 1 to 6, in which the total value of the areas of the engaging head portions 23 of the engaging elements 20 arranged per 1 $cm^2$ was 10,000,000 $\mu m^2$ or more, the fluctuation in the coefficient of kinetic friction occurring in the friction test was a small value, namely, 0.06 or less, in all cases. Thus, it was confirmed that the surface fastener 1 had good texture.

With the surface fasteners 1 of Examples 1 to 6, which were made of polypropylenes having a tensile modulus of 700 MPa or more and 2300 MPa or less, it was confirmed that the engaging elements 20 having the engaging pawl portions 24 whose pawl back surfaces had an inclination angle θ of 70° or less were stably molded. These surface fasteners 1 of Examples 1 to 6 had a high peel strength with an average value of 0.25 N/cm or more. In particular, it was confirmed that the surface fastener 1 of Example 1 had a high peel strength, despite that the average of the areas of the engaging head portions 23 of the engaging elements 20 was large, namely, 80,000 $\mu m^2$.

Meanwhile, with the surface fasteners of Comparative Examples 1 to 3, the formation densities of the engaging elements were smaller than 300 number/$cm^2$, and the total values of the areas of the engaging head portions of the engaging elements arranged per 1 $cm^2$ were smaller than 10,000,000 $\mu m^2$. Thus, with each of the surface fasteners of Comparative Examples 1 to 3, the fluctuation in the coefficient of kinetic friction measured in the friction test was larger than 0.06, and thus, a good texture was not obtained.

The surface fastener of Comparative Example 4 is made of a polypropylene having a tensile modulus of less than 700 MPa. Hence, in the surface fastener of Comparative Example 4, the engaging elements having the engaging pawl portions whose pawl back surfaces have an inclination angle θ of larger than 70° were formed. Thus, in Comparative Example 4, although the total value of the areas of the engaging head portions of the engaging elements arranged per 1 $cm^2$ was 10,000,000 $\mu m^2$ or more, the fluctuation in the coefficient of kinetic friction occurring in the friction test was larger than 0.06, and thus, a good texture was not obtained. This may be because the engaging pawl portions having an inclination angle θ of more than 70° affect the texture of the surface fastener.

In addition, in the surface fastener of Comparative Example 4, because the inclination angle θ was larger than 70°, the average value of the peel strength was extremely small, namely, 0.16 N/cm. Thus, it was confirmed that a peel strength suitable for use in disposable diapers, diaper covers, and the like was not obtained.

The present invention is not limited to the embodiment and examples described above, and various modifications can be made as long as such modifications have substantially the same configuration as that of the present invention and exhibit the same advantageous effects.

For example, in the above-described embodiment, the engaging head portion 23 of the engaging element 20 is provided with a pair of fine right and left engaging pawl portions 24, as illustrated in FIG. 2. However, in the present invention, the shape of the engaging element is not particularly limited as long as the engaging element has a stem portion, an engaging head portion, and at least one engaging portion, such as an engaging pawl portion, protruding from the outer circumference portion of the engaging head portion.

For example, in the present invention, the fine, right and left engaging pawl portions of the engaging element 20 may be provided at positions different from those in the above-described embodiment. Specifically, the engaging element of the present invention includes, for example, an engaging element in which left and right engaging pawl portions are provided at positions displaced forward or backward from the central portion of the engaging head portion in the machine direction MD and an engaging element in which four engaging pawl portions are provided on one engaging head portion.

Furthermore, in the manufacturing apparatus 40 for manufacturing the surface fastener 1 of this embodiment, the positions of the through-holes 52*a* provided in the outer cylindrical body 52 and the positions of the grooves 53*a* provided in the inner cylindrical body 53 can be displaced in the machine direction due to the influence of machining accuracy or the like in producing the outer cylindrical body 52 and the inner cylindrical body 53 of the primary molding device 50. Taking this possibility into consideration, in the surface fastener 1 of this embodiment, the plurality of engaging elements 20 provided in one base portion 10 only need to include at least some, preferably 10% or more, and more preferably 20% or more, engaging elements 20 having two fine right and left engaging pawl portions 24.

In that case, the engaging elements 20 provided on one base portion 10 may include, besides the engaging elements 20 having the shape illustrated in FIG. 2, for example, engaging elements in which the right and left engaging pawl portions are provided at positions displaced forward or backward from the central portion of the engaging head portion in the machine direction MD, engaging elements in which four fine engaging pawl portions are provided on one engaging head portion, engaging elements in which it is difficult to clearly determine if the engaging pawl portions are formed, and engaging elements in which no engaging pawl portion is provided on the engaging head portion.

REFERENCE SIGNS LIST

1 SURFACE FASTENER
10 BASE PORTION
20 ENGAGING ELEMENT
21 ENGAGING ELEMENT ROW
22 STEM PORTION
23 ENGAGING HEAD PORTION
23*a* HEAD TOP SURFACE
23*b* HEAD OUTER-CIRCUMFERENTIAL SIDE SURFACE
23*c* HEAD BACK SURFACE
24 ENGAGING PAWL PORTION (ENGAGING PORTION)
25 BOUNDARY PORTION
26 VIRTUAL VERTICAL LINE
30 PRIMARY MOLDED BODY
31 PRIMARY ELEMENT
32 PRIMARY STEM PORTION
33 RIB PORTION
34 PROTRUSION (PRIMARY ENGAGING PAWL PORTION)
40 MANUFACTURING APPARATUS
50 PRIMARY MOLDING DEVICE
51 DIE WHEEL
52 OUTER CYLINDRICAL BODY (OUTER SLEEVE)
52*a* THROUGH-HOLE
53 INNER CYLINDRICAL BODY (INNER SLEEVE)
53*a* GROOVE (RECESS)
54 ROTARY DRIVING ROLLER
55 SUPPLY NOZZLE PART
56 PICKUP ROLLER
57 UPPER NIP ROLLER
58 LOWER NIP ROLLER
60 HEATING AND PRESSING DEVICE (SECONDARY MOLDING DEVICE)
61 UPPER PRESSING ROLLER (CALENDER ROLLER)
62 LOWER PRESSING ROLLER (CALENDER ROLLER)
70 FRICTION TESTING MACHINE
71 WORK STAGE
72 CONTACTOR
73 RESIN ARM
74 SILICONE FOAM PLUG
75 DETECTOR
81 FIRST TEST PIECE
82 SECOND TEST PIECE
83 CUT PIECE
84 SUPPORT MEMBER
85 NONWOVEN FABRIC

The invention claimed is:

1. A surface fastener made of a synthetic resin, comprising: a flat plate-shaped base portion formed to have a large length in a machine direction; and a plurality of engaging elements provided on an upper surface of the base portion, wherein each of the engaging elements includes a stem portion standing upright from the base portion, an engaging head portion provided at a top end portion of the engaging element and extending outward with respect to a boundary portion with the stem portion, and at least one engaging portion protruding from an outer circumference portion of the engaging head portion, a total of areas of the engaging head portions per 1 $cm^2$ of the surface fastener is 10,000,000 $\mu m^2$ or more when the surface fastener is viewed in plan view from above, and the synthetic resin has a tensile modulus of 700 MPa or more and 2300 MPa or less.

2. The surface fastener according to claim 1, wherein a formation density of the engaging elements is 300 number/$cm^2$ or more.

3. The surface fastener according to claim 1, wherein a base end portion of the engaging portion of each of the engaging elements is formed to have a width smaller than half a dimension of the boundary portion of the engaging element in a direction perpendicular to the machine direction, the engaging portion protrudes obliquely downward toward the base portion from the outer circumference portion of the engaging head portion, and an inclination angle at which a back surface of the engaging portion is inclined with respect to an upper-lower direction of the surface fastener is 70° or less.

* * * * *